US009868049B2

(12) United States Patent
Santoro

(10) Patent No.: US 9,868,049 B2
(45) Date of Patent: Jan. 16, 2018

(54) INDOOR FOOTBALL GAME

(71) Applicant: Football Kings LLC, Philadelphia, PA (US)

(72) Inventor: Thomas Santoro, Moorestown, NJ (US)

(73) Assignee: Football Kings LLC, Philadelphia, PA (US)

( * ) Notice: Subject to any disclaimer, the term of this patent is extended or adjusted under 35 U.S.C. 154(b) by 0 days.

(21) Appl. No.: 15/412,174

(22) Filed: Jan. 23, 2017

(65) Prior Publication Data

US 2017/0209776 A1 Jul. 27, 2017

Related U.S. Application Data

(60) Provisional application No. 62/281,786, filed on Jan. 22, 2016.

(51) Int. Cl.

| | |
|---|---|
| ***A63F 1/00*** | (2006.01) |
| ***A63F 1/06*** | (2006.01) |
| *A63F 3/00* | (2006.01) |

(52) U.S. Cl.

CPC ..... *A63F 1/00* (2013.01); *A63F 1/067* (2013.01); *A63F 3/00041* (2013.01); *A63F 2001/001* (2013.01); *A63F 2001/003* (2013.01); *A63F 2001/005* (2013.01); *A63F 2003/00164* (2013.01)

(58) Field of Classification Search

CPC ..... A63F 3/00041; A63F 1/067; A63F 2003/00164; A63F 2001/001; A63F 2001/003; A63F 2001/005; A63F 1/00

USPC ..... 273/298, 247, 292, 274, 309

See application file for complete search history.

(56) References Cited

U.S. PATENT DOCUMENTS

| | | | | |
|---|---|---|---|---|
| 3,423,090 | A * | 1/1969 | Pfund | A63F 3/00041 273/247 |
| 3,730,528 | A * | 5/1973 | Corrado | A63F 3/00041 273/247 |
| 6,022,023 | A | 2/2000 | Ford, Jr. | |
| 6,322,073 | B1 * | 11/2001 | Davis | A63F 3/00041 273/236 |
| 7,207,562 | B1 * | 4/2007 | Gallagher | A63F 1/00 273/247 |
| 2008/0197573 | A1 * | 8/2008 | Palmer | A63F 1/04 273/298 |
| 2009/0039601 | A1 | 2/2009 | Carpe | |
| 2011/0012306 | A1 | 1/2011 | Chew, Jr. | |
| 2012/0175843 | A1 * | 7/2012 | Twersky | A63F 1/04 273/277 |
| 2013/0300063 | A1 * | 11/2013 | Eller | A63F 1/00 273/292 |

* cited by examiner

*Primary Examiner* — Benjamin Layno
(74) *Attorney, Agent, or Firm* — Norman E. Lehrer

(57) ABSTRACT

A casino table game having a football motif is played on a standard table that resembles a blackjack table having six or seven betting positions around the same. Each betting position includes a symbol for a home team and a visiting team so that each player can place a bet on either. Additional side or bonus bets can also be made. The game is played with a standard deck of 52 cards with jokers. The table layout resembles a football field and includes spots for the dealer to place four cards for the home team and four cards for the visiting team. In the simplest form of the game, the team with the most points after adding up the four cards wins.

5 Claims, 3 Drawing Sheets

INDOOR FOOTBALL GAME

CROSS REFERENCE TO RELATED APPLICATION

This application claims the benefit of prior U.S. Provisional Patent Application No. 62/281,786, filed Jan. 22, 2016.

BACKGROUND OF THE INVENTION

The present invention is directed toward a card game and, more particularly, toward such a game that is intended to be played as a table gambling game in a casino. The game could, however, be played at home with or without gambling.

The American public loves American football and other sports. Also, gamblers love to mix gambling with sports. There are, however, very few gambling games that utilize sports themes. Those that are known are somewhat complex, making them somewhat undesirable to play.

Published U.S. Patent Application No. 2009/0039601 to Carpe, for example, shows a football-themed card game while U.S. Pat. No. 6,022,023 shows a card game having a basketball motif. The rules of these games, however, are somewhat complex and do not lend themself well to be played as a table game in a casino.

It is believed that a simple table card game having a football theme would be a real draw for a casino as it would be both entertaining and exciting, thereby encouraging players to stay at the table. It is believed that a need exists for a simple casino table game that has a football theme.

SUMMARY OF THE INVENTION

The present invention is designed to overcome the deficiencies of the prior art discussed above. It is an object of the present invention to provide a simple casino table card game with a football theme that will keep players at the table because of its simplicity and excitement of play.

In accordance with the illustrative embodiment demonstrating features and advantages of the present invention, there is provided a casino table game having a football motif. The game is played on a standard table that resembles a blackjack table having six or seven betting positions around the same. Each betting position includes a symbol for a home team and a visiting team so that each player can place a bet on either. Additional side or bonus bets can also be made. The table layout resembles a football field and includes spots for the dealer to place four cards for the home team and four cards for the visiting team. In the simplest form of the game, the team with the most points after adding up the four cards wins.

Other objects, features, and advantages of the invention will be readily apparent from the following detailed description of the preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
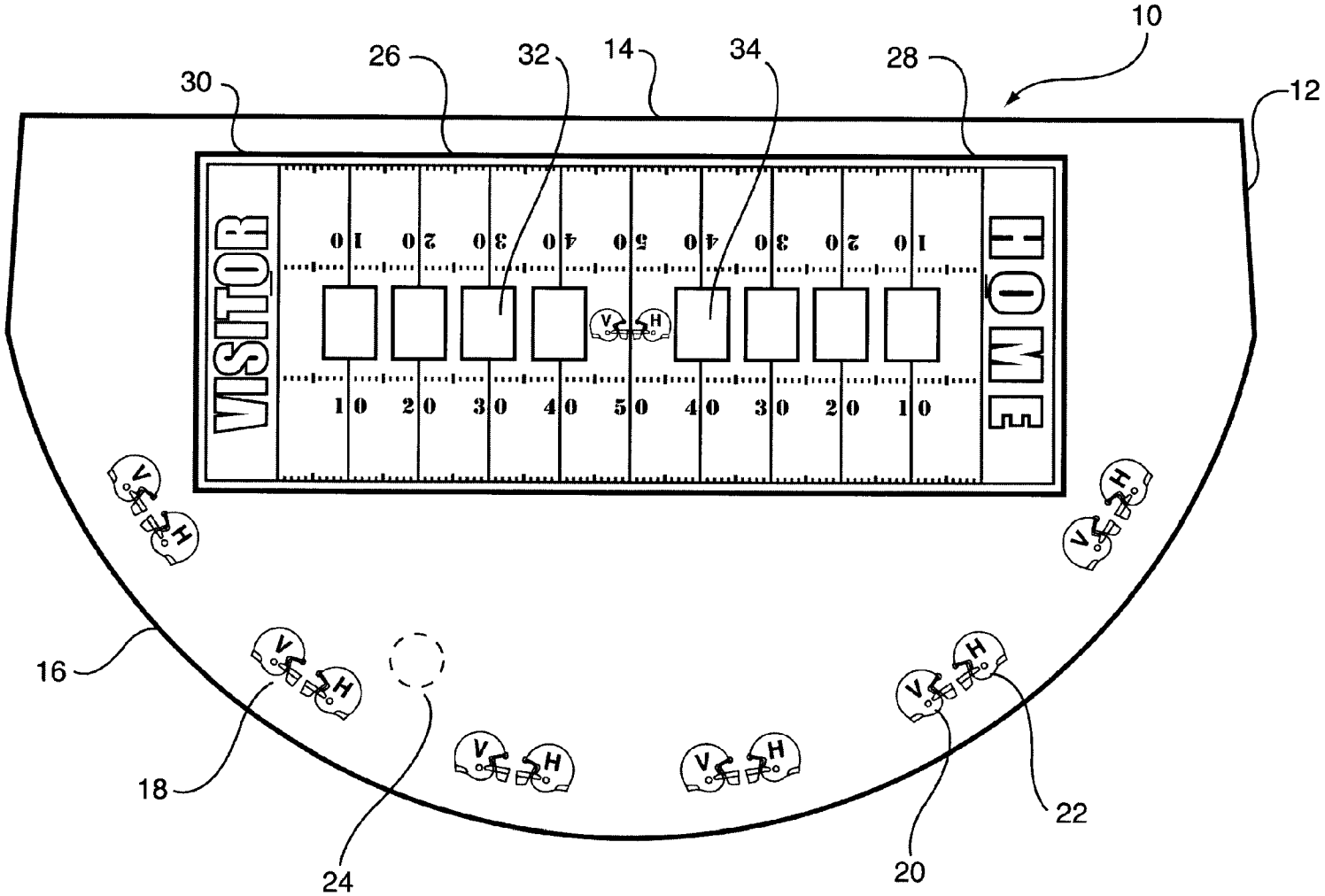
FIG. 1 is a top view of the game layout of the invention as it might appear on a standard casino gaming table.
Figure 2:
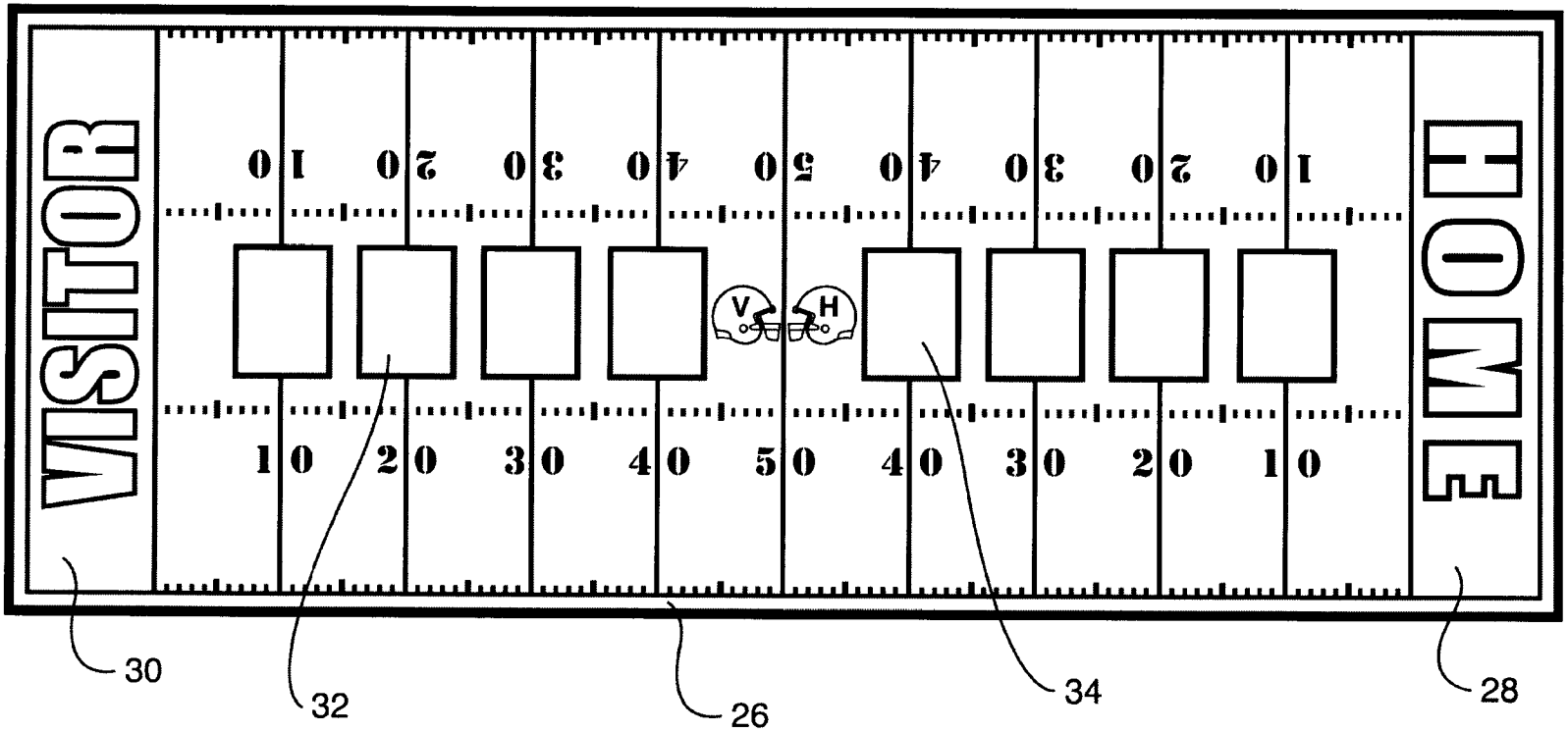
FIG. 2 is a top view showing more of the detail of the football field layout of the game.
Figure 3:
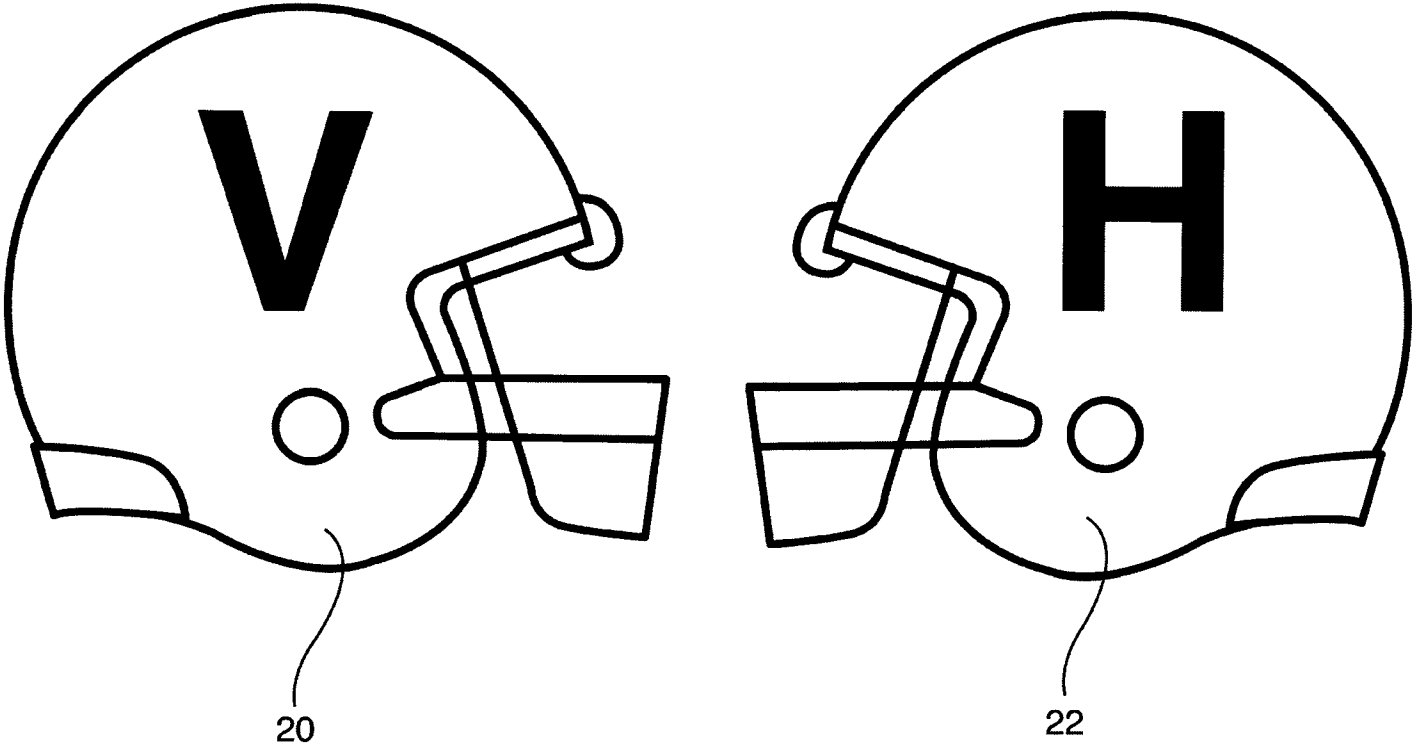
FIG. 3 is a top view showing an example of the betting spots that can be used with the invention.

Referring now to the drawings in detail wherein like reference numerals have been used throughout the various figures to designate like elements, there is shown in FIG. 1 a casino football-themed card game in accordance with the principles of the present invention and designated generally as 10. The game 10 is played with a standard deck of 52 playing cards (along with jokers) on a standard gaming table such as shown at 12.

The table 12, as is well known in the art, includes a top that is essentially semi-circular having a straight side 14 where a dealer is normally positioned. The curved side 16 includes six player positions such as shown, for example, at 18. This is, of course, by way of example only as a fewer or greater number of player positions can be included.

Each player position includes a betting space where a player can place a bet for either the visiting team or the home team. In the preferred embodiment, the visiting team and home team betting positions are shown by football helmets 20 and 22. There may also be an additional betting space 24 at each player position for side bets or bonus bets that can be included in the game.

In the center of the table extending across the same is a representation of a football field such as shown at 26. One side 28 of the football field 26 is designated as the "Home" side of the field while the other side 30 is designated as the "Visitor" side. As can be seen, there are nine spaced apart parallel lines representing the 50 yard line and the 10, 20, 30 and 40 yard lines for each team. On the 10, 20, 30 and 40 yard lines on both sides of the field 26 are spaces such as shown at 32 and 34 that are approximately the size of a playing card.

In the simplest form of the game, the dealer deals four cards to the home team and four cards to the visitor team. This is done by turning over one card at a time on the 10 yard space for the home team and then for the visitor team. This represents the first quarter of the game. The play progresses by turning over a card on the 20 yard line for each team and then the 30 and 40 yard line representing the four quarters.

The cards have face value except that picture cards are 10 points. After the cards are dealt, the point count for the four home team cards are added and the point count for the four visitor team cards are added. The team with the highest points is the winner. Prior to playing, each player places a bet on the helmet for either the home team or the visitor team. If the player wins, he is paid. If he or she loses, the bet is lost to the house.

Numerous variations are possible. For example, after each team receives the first two cards, the players may be permitted the option of doubling down. That is, they can now double their bet hoping that their team wins.

The game can also be played with wild cards. These can be the two jokers and four aces or substantially any other cards that are chosen. If a wild card shows up in the first, second or third quarters of the game, the joker will not count and the ace will count as one point. If, however, the joker is dealt in the fourth quarter, it will automatically tie the game no matter what the final score is.

The additional betting spot on the table can be used for side bets. For example, a player can place a bet that his chosen team will win by more than a certain number of points. Alternatively, the rules can include additional features such as bonuses being paid if one team wins by more than a certain number of points or if certain points are reached.

Even further, other bonus side bets are available such as the team drawing four of a kind or any other predetermined arrangement of cards. The amount of the payment of the bonus bet will be based on a payout schedule which can be mathematically determined.

The present invention may be embodied in other specific forms without departing from the spirit or essential attributes thereof and accordingly, reference should be made to the appended claims rather than to the foregoing specification as indicating the scope of the invention.

I claim:

1. A football card game comprising:

a standard deck of 52 playing cards;

a game table having an upper surface;

a game layout on said surface, said game layout including a periphery with a plurality of betting areas spaced about a portion of said periphery;

said game layout further having a width and a length, said length having a first end and a second end, said game layout further having markings thereon resembling a football playing field and including nine equally spaced apart parallel lines, a first line is adjacent said first end and is identified with the number 10, the next adjacent line is identified with the number 20, the next adjacent line is identified with the number 30, the next adjacent line is identified with the number 40, the next adjacent line which is the center line is identified with the number 50, the next adjacent line is identified with the number 40, the next adjacent line is identified with the number 30, the next adjacent line is identified with the number 20 and the last line adjacent the second end is identified with the number 10, and eight substantially rectangularly shaped boxes on said layout, a different one of said boxes being associated with each of said lines identified with the numbers 10, 20, 30 and 40, said boxes being substantially the same size and shape as one of said playing cards.

2. The football card game as claimed in claim 1 wherein the word visitor appears at said first end of said layout and the word home appears at said second end.

3. The football card game as claimed in claim 1 wherein said betting areas are in the form of football helmets.

4. The football card game as claimed in claim 3 including an additional side bet area adjacent each of said betting areas.

5. The football card game as claimed in claim 1 wherein said deck of cards further includes two jokers.

* * * * *